US005701612A

United States Patent [19]

Daneshvar

[11] Patent Number: 5,701,612

[45] Date of Patent: Dec. 30, 1997

[54] URINAL CONTAINER HAVING INTERNAL PARTITIONS AND MOTOR-POWERED SUCTION DEVICE

[76] Inventor: Yousef Daneshvar, 21459 Woodfarm, Northville, Mich. 48167

[21] Appl. No.: 487,297

[22] Filed: Jun. 7, 1995

Related U.S. Application Data

[63] Continuation-in-part of Ser. No. 251,503, May 31, 1994, which is a continuation-in-part of Ser. No. 877,430, May 1, 1992, abandoned.

[51] Int. Cl.[6] ..... A47K 11/12

[52] U.S. Cl. ..... 4/144.3; 4/144.1; 4/431

[58] Field of Search ..... 4/144.1, 144.2, 4/144.3, 283, 301, 316, 321, 431, 455, 114.1; 604/315, 326, 329, 333, 349

[56] References Cited

U.S. PATENT DOCUMENTS

| | | | |
|---|---|---|---|
| 1,440,765 | 1/1923 | Buckley | 4/144.1 |
| 2,944,551 | 7/1960 | Breer | 604/315 X |
| 2,951,251 | 9/1960 | Belden | 4/321 X |
| 3,533,109 | 10/1970 | Kishimoto | 4/144.1 X |
| 4,345,341 | 8/1982 | Saito | 4/144.3 X |
| 4,360,933 | 11/1982 | Kimura et al. | 4/144.1 X |
| 4,631,061 | 12/1986 | Martin | 4/301 X |
| 4,747,166 | 5/1988 | Kuntz | 4/144.1 |

*Primary Examiner*—Robert M. Fetsuga

[57] ABSTRACT

A urinal has a collection device for placement proximate genitalia to receive urine from a person. Tubing from the collection device extends to a container. The container has an opening proximate the junction of its sidewall and its top wall via which urine may be poured out of the container when the container is tipped. A motor-powered suction device is mounted on the container for sucking urine through the tubing into the container. The entire suction device is mounted on the container proximate the junction of the top wall and the sidewall at a location that is opposite the location of the pour-out opening. The container has internal partitions, and a filter is disposed between the container headspace and the suction device.

11 Claims, 8 Drawing Sheets

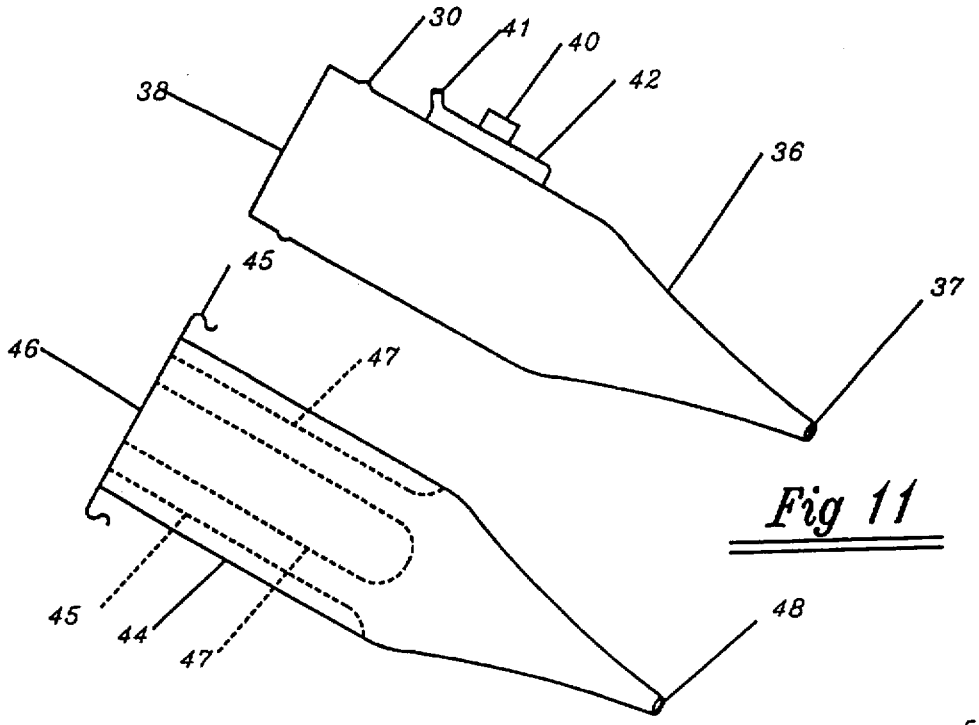
Fig 11
Fig 12
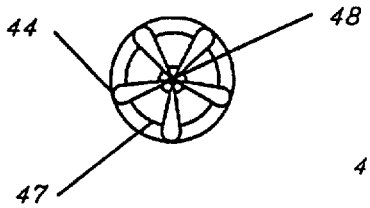
Fig 13
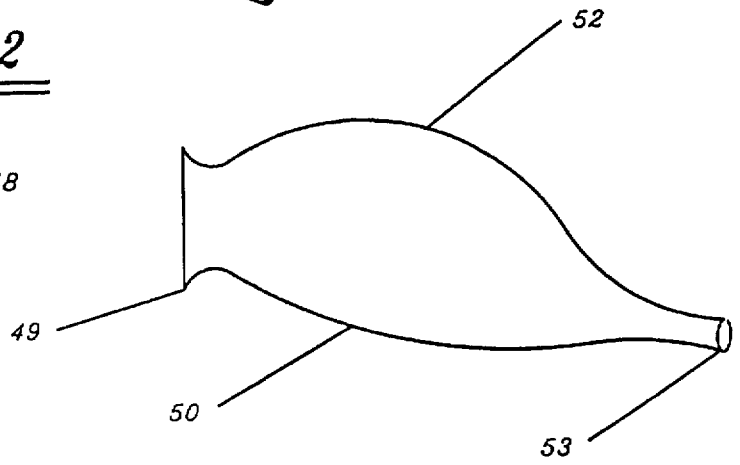
Fig 14
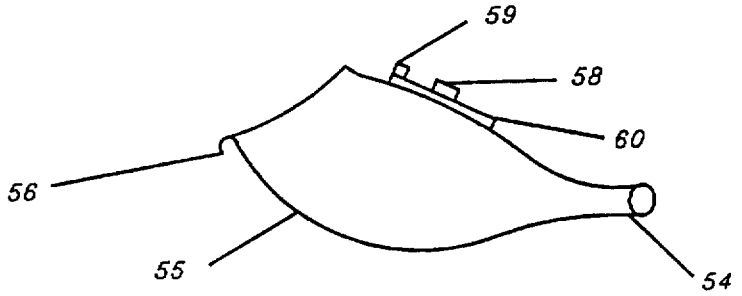
Fig 15

URINAL CONTAINER HAVING INTERNAL PARTITIONS AND MOTOR-POWERED SUCTION DEVICE

This application is a continuation-in-part of co-pending application Ser. No. 08/251,503, filed May 31, 1994, which is a continuation-in-part of Ser. No. 07/877,430, filed May 1, 1992, abandoned.

BACKGROUND

One common problem that occurs in patients is difficulty in going to the bathroom for urination. This happens with severe arthritis, fractured hips, strokes, and at times with old age. The problem gets worse if these patients have to urinate even more due to bladder infection or irritation, or change in age. Frequent trips to the bathroom can be dangerous when they occur at a wrong time, such as in the middle of the night, in low light, and when ah old patient is not totally alert and in control. They may cause falling and fall-related, serious injuries to occur.

The regular methods of using bedpans and urinals are not good answers for such circumstances. They are not comfortable, and there is the possibility of spilling. Overall, using them; in the middle of the night is a problem, and in practice they have proven to be unpopular.

Urination after certain procedures, such as cardiac catheterization, or certain operations when a patient has to lie flat, cause significant discomfort in patients. I have patients who do not take diuretics before coming to my office, since they cannot keep up with the need for urination. Foley catheters have their own problems of discomfort and irritation as well as causing infection of the bladder which is quite common with their use.

Having these important practical issues in mind, in this application I introduce a urinal that will suction the urine to a plastic container by use of a suction fan or small electric pump. I believe this will be quite useful in many of such circumstances. I have the sincere hope that in many of such cases this product will prevent discomfort and injuries to the patients who use it.

BRIEF SUMMARY OF INVENTION

This invention is based on a mechanism that will carry the urine from a small collecting device by a soft flexible plastic tubing to a container. Collecting devices are introduced that match men's and ladies' external genitalia and allow collection of urine to be comfortable. The container has an electric suction fan that creates a vacuum to suction the urine into the container. In other models a small electric pump suctions urine into the container. An electric switch on the collecting device allows the fan or pump to be turned on and off.

A variety of collecting devices are introduced to allow their use in certain patients and special circumstances that occur. A small glowing bulb will help the collecting device to be located at dark. I have the belief that this unit will be very helpful in many cases and will make life much easier for certain people.

BRIEF DESCRIPTION OF THE DRAWINGS

FIG. 11 is a view of a third collecting device.

FIG. 12 is a view of an insert that is used with the device of FIG. 11.

FIG. 13 is a view in the direction of arrow 13 in FIG. 12.

FIG. 14 is a view of another form of insert for use with a fourth collecting device.

FIG. 15 is a view of the fourth collecting device.

DETAILED DESCRIPTION OF THE INVENTION

Figure 24:
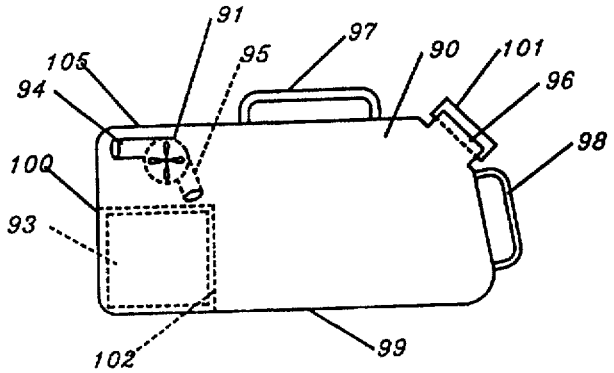
FIG. 24 is a view of a second embodiment of special urinal.
Figure 25:
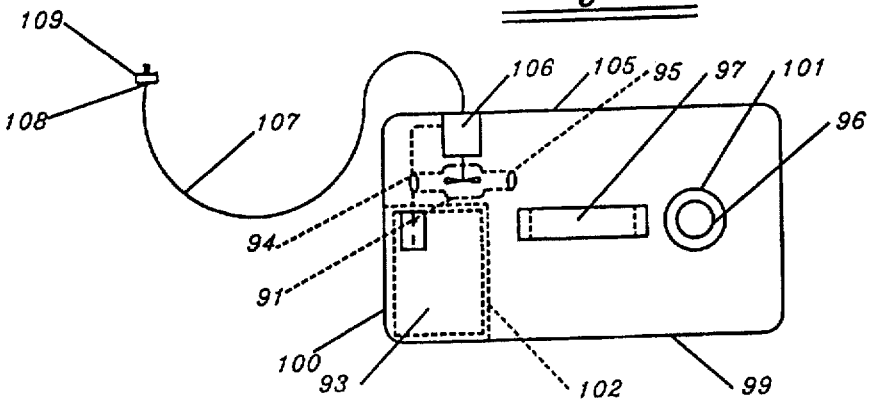
FIG. 25 is a top view of FIG. 24.
Figure 26:
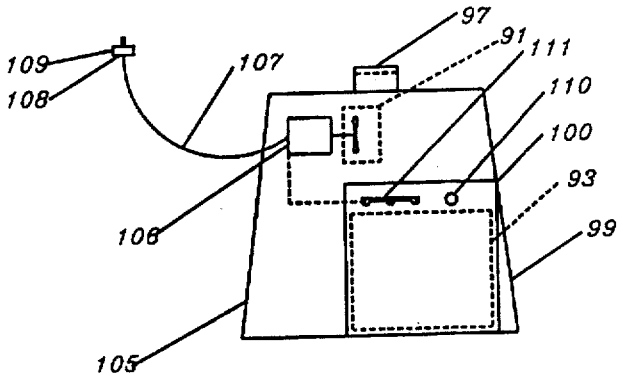
FIG. 26 is a left side view of FIG. 24.
Figure 27:
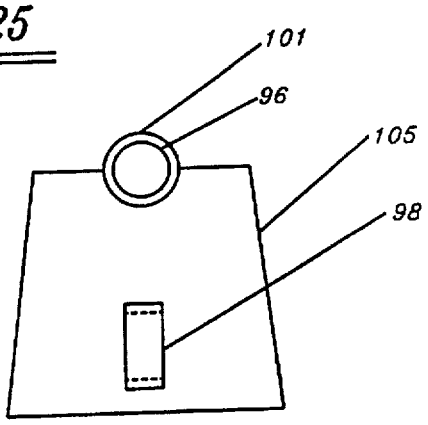
FIG. 27 is a right side view of FIG. 24.

This invention consists of three main different parts: A container (shown in FIGS. 1 and 24) made from a clear plastic and designed to receive and hold about two to four liters of urine until it can be emptied; a collecting device (such as in FIGS. 7, 9 and 11) that collects urine from a male or female; and a means for suctioning the urine from the collecting device to the container either by creating vacuum in the container or using a small electric pump (such as in FIGS. 4, 5, and 24).

Figure 1:
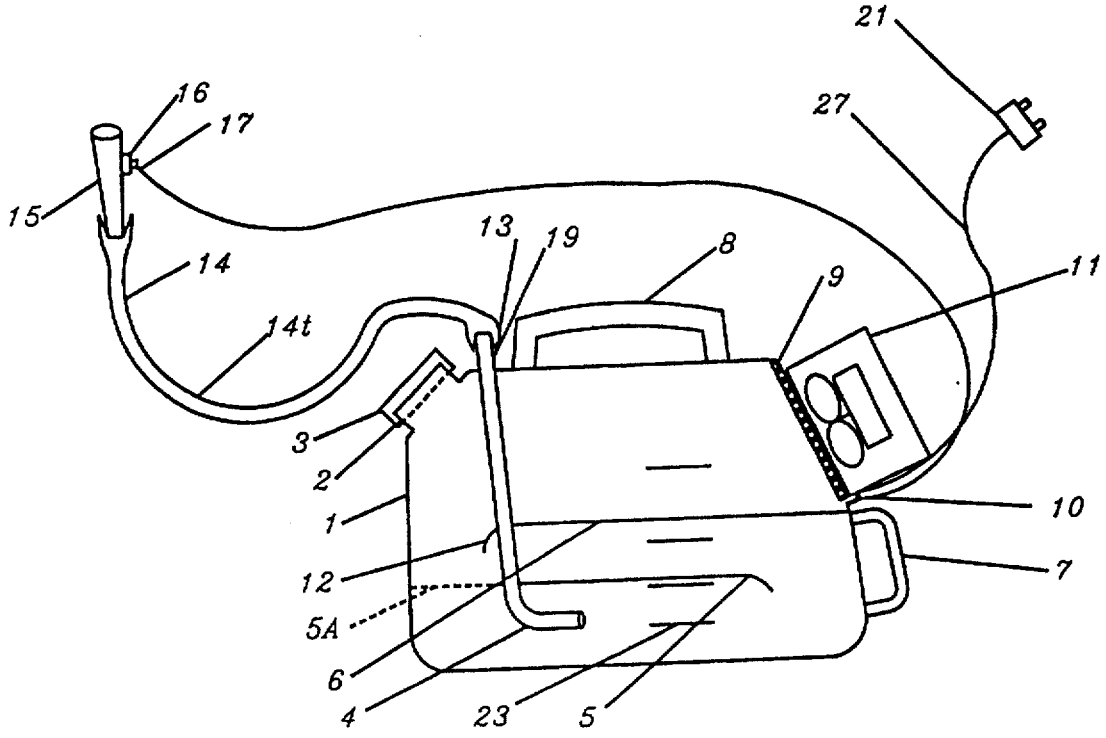
FIG. 1 is an elevational view of my special urinal.
Figure 2:
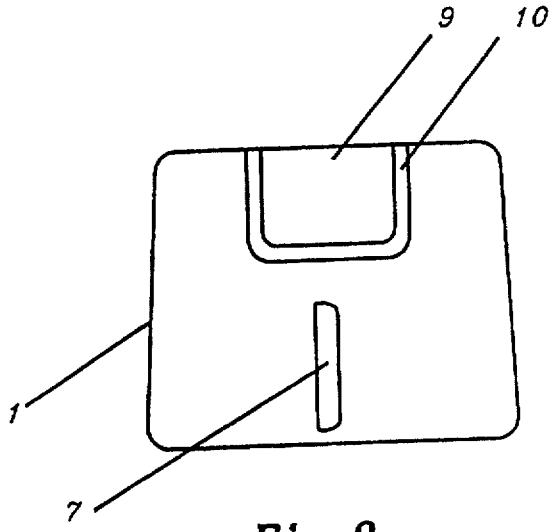
FIG. 2 is a right side view of FIG. 1.
Figure 3:
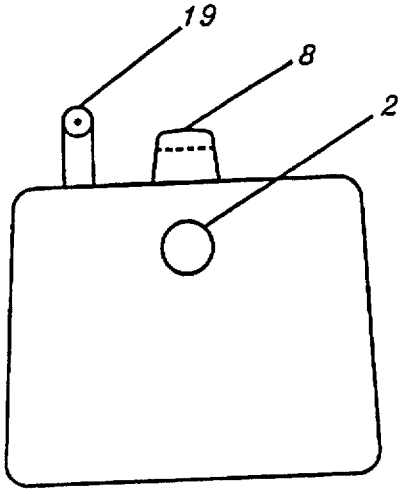
FIG. 3 is a left side view of FIG. 1.

FIGS. 1–3 show a first embodiment of special urinal comprising a container 1 having two handles 7 and 8, one 8 in the top, and one 7 in the side. There are numbered graduations 23 in the side for measuring the amount of urine. The container is made from clear or mildly colored plastic. It has a wide base providing sturdy support on the floor. A space 9 in the right upper corner is designed to hold inserted filters (such as a carbon filter) for removal of smell as well as tiny particles of urine which may have escaped internal barriers. A suction fan 11 is inserted over the inserted filters and connects to electricity by a cord 27 and plug 21. The container has barriers 5 and 6 inside itself like flat shelves that prevent free movement of small droplets of urine to the suction area. The lower barrier 5 has holes 5A in the left side of the container to allow the urine to drain when the container is to be emptied. The container has an opening 2 covered by a cap 3 in order to allow emptying of the urine.

A collecting part 15 in the form of a tubular or long funnel-shaped piece is shown at the left side. It has a shape to make collection of urine from a patient easy and it connects to one end 14 of a plastic tube 14*t*. There is an electric switch 16 that turns the unit off and on, and a small light signal 17 is located in the switch to glow at night to help locate the unit. The urine comes through tube 14*t* and the other end 13 connects to one end of another tube 19 on the container which carries the urine to the bottom of the container, ending at 4.

FIG. 2 shows space 9 for the filters, and also a rim 10 that allows fan 11 to slide inside it. Fan 11 suctions the air out of the container in order to create a vacuum, and this vacuum suctions the urine into the container. To prevent urine from going into the fan, layers of filters are used; one of cotton to absorb urine particles that may be in the air; another filter made from activated charcoal to remove odor of the urine. Barriers 5 and 6 are flat horizontal walls designed to prevent free motion of urine particles and foam. The urine enters the container via tube 19 and is then delivered to the bottom of the container by continuation of the same tube.

Figure 4:
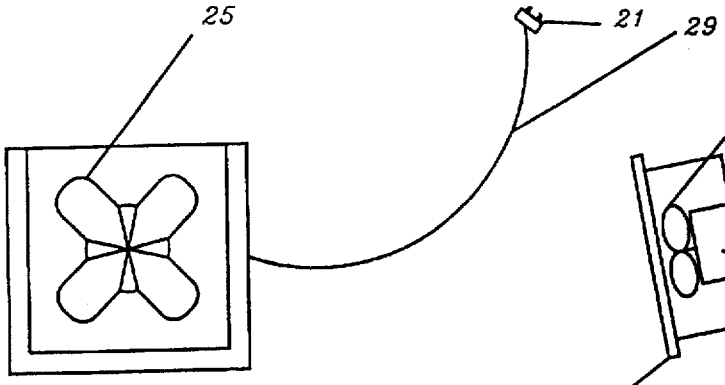
FIG. 4 is a front view of a fan that is used with the urinal.
Figure 5:
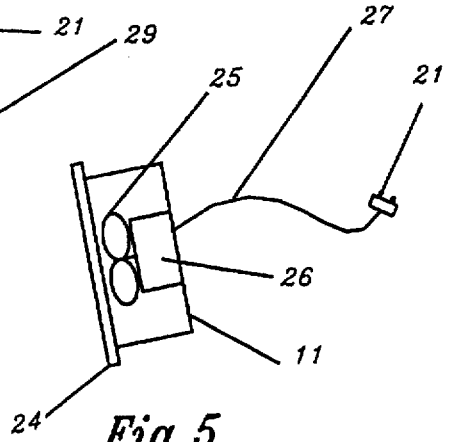
FIG. 5 is a right side view of FIG. 4.
Figure 6:
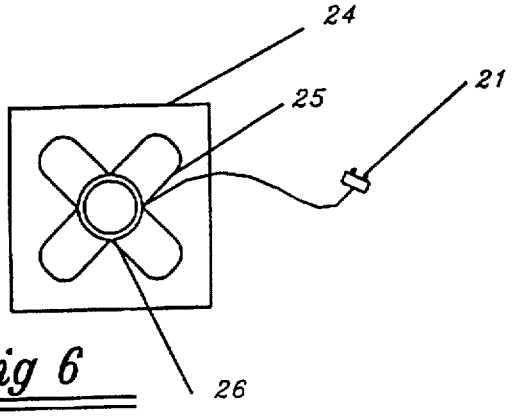
FIG. 6 is a rear view of FIG. 4.

FIGS. 4, 5 and 6 show fan 11 to comprise a rim 24 that is to slide in rim 10. The fan also comprises blades 25, an electric motor 26, and cord 27 leading to plug 21.

Figure 7:
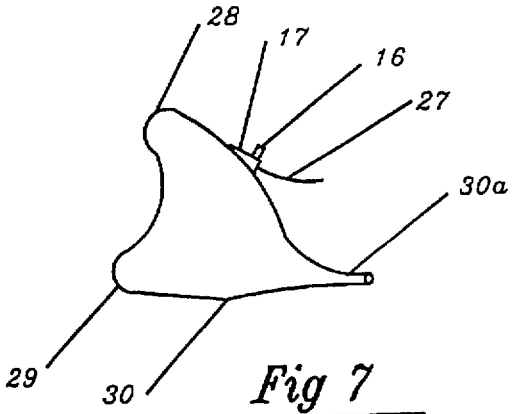
FIG. 7 is a view of a urine collecting device.
Figure 8:
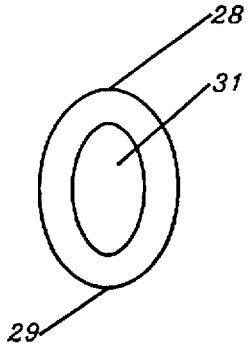
FIG. 8 is a left side view of FIG. 7.

FIGS. 7 and 8 show a collecting piece designed for collection of urine from ladies. The switch 16 is shown with a small glowing light 17. The upper pole is 28, and the lower pole is 29. The lower part comprises a drain 30 and an end piece 30*a* for fitting to plastic tubing. The opening to accept the urine is 31.

Figure 9:
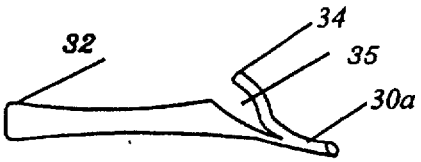
FIG. 9 is a view of a second collecting device.
Figure 10:
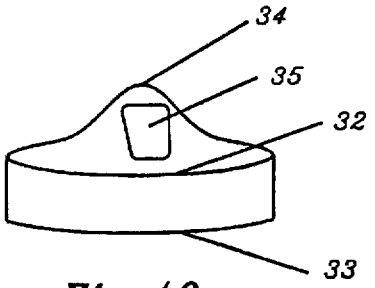
FIG. 10 is a left side view of FIG. 9.
Figure 16:
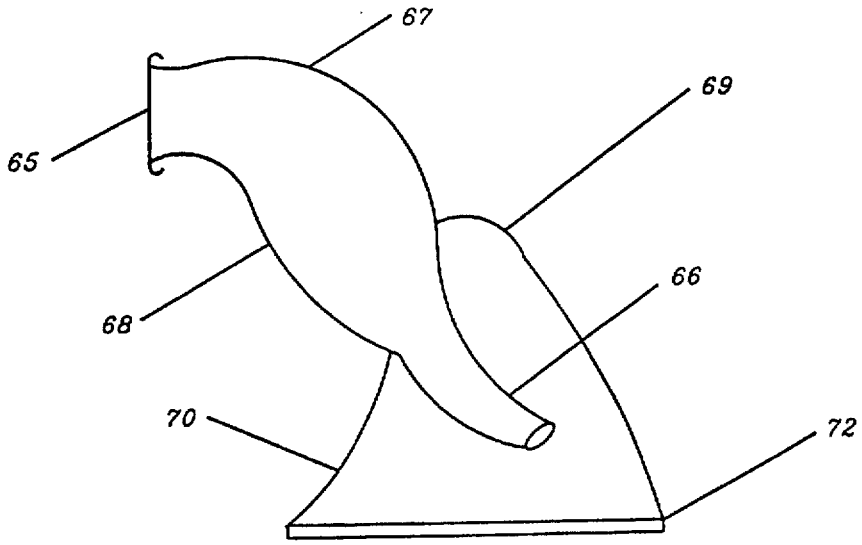
FIG. 16 is a view of a fifth collecting device.
Figure 17:
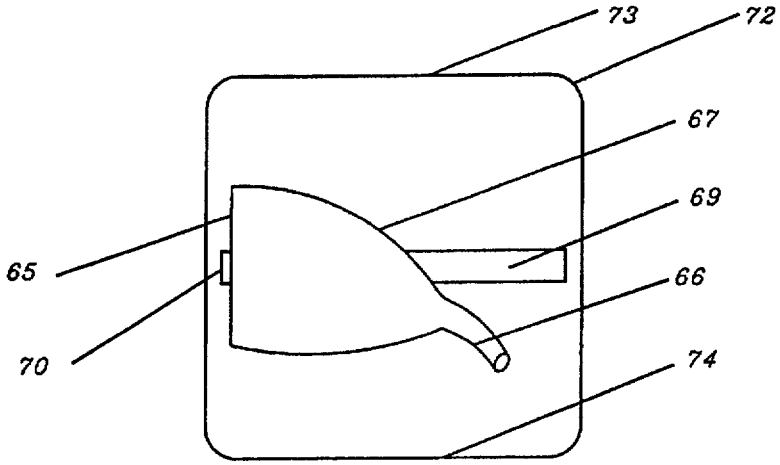
FIG. 17 is a top view of FIG. 16.
Figure 18:
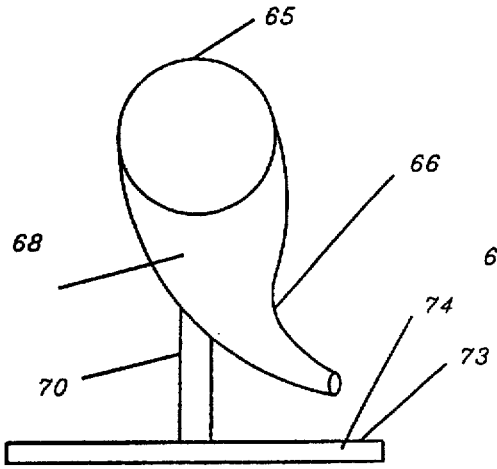
FIG. 18 is a left side view of FIG. 16.
Figure 19:
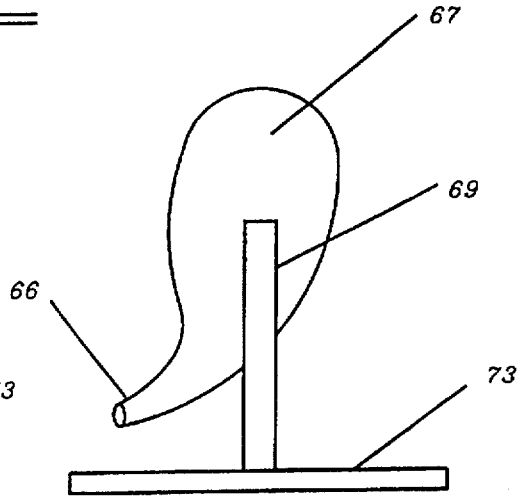
FIG. 19 is a right side view of FIG. 16.
Figure 20:
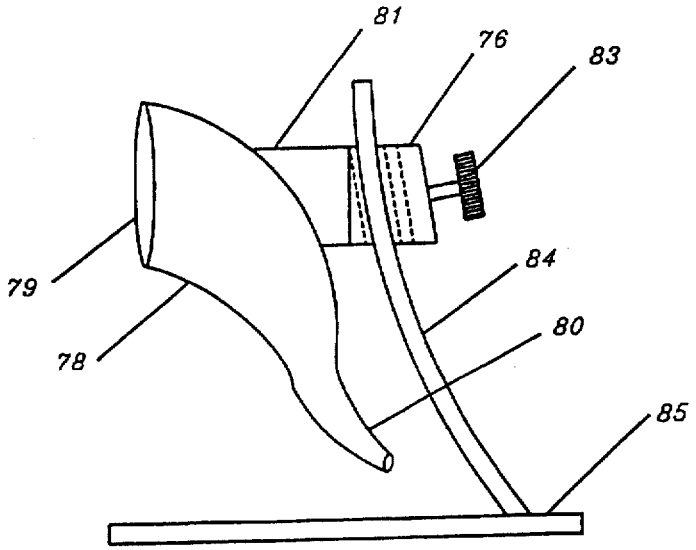
FIG. 20 is a view of a fifth collecting device.
Figure 21:
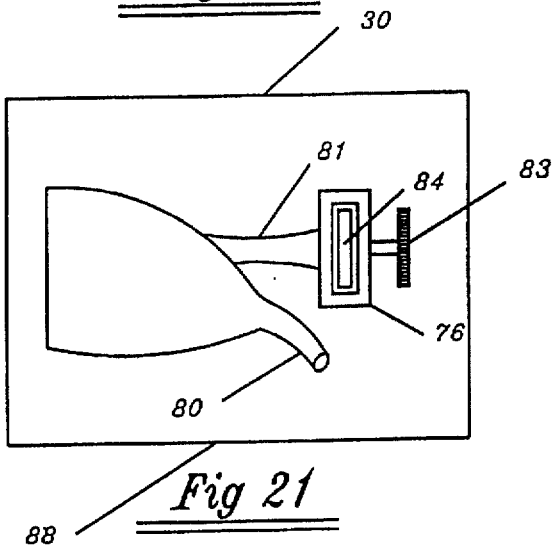
FIG. 21 is a top view of FIG. 20.
Figure 22:
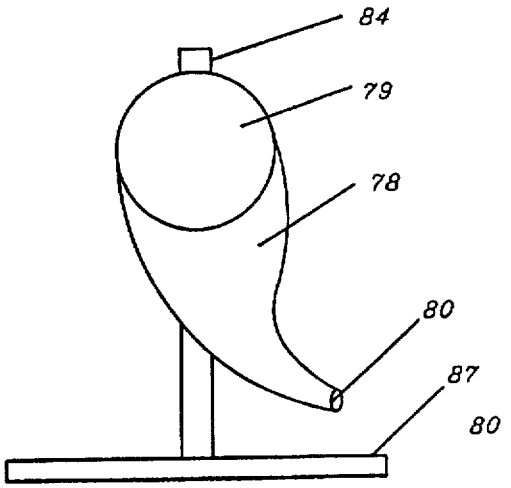
FIG. 22 is a left side view of FIG. 20.
Figure 23:
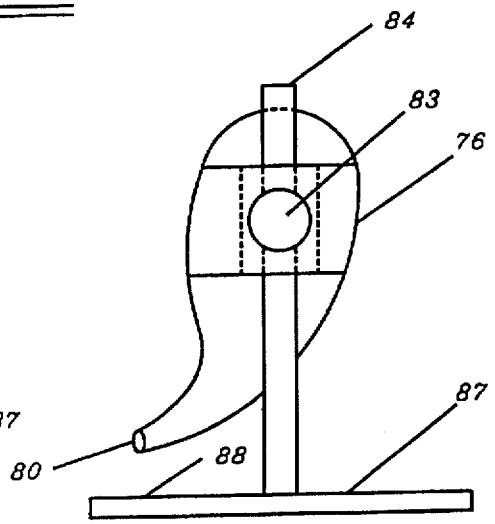
FIG. 23 is a right side view of FIG. 20.

FIGS. 9 and 10 show a collecting device which allows a male or female patient to sit on it and use it. This is designed for patients that cannot hold the urinal in place and holding the urinal makes them tired or uncomfortable. These views show a soft surface 32 which a patient can sit on, and a lower surface 33 for staying on a mattress. A part 34 stands against the pubic area, and a space 35, accepts the urine. An end piece 30*a* takes the urine to the plastic tubing.

FIG. 11 shows the side view of another piece 36 for collecting urine. This is somewhat larger than a large condom allowing a penis to enter or the opening of a urethra to stand against it. It is primarily designed to be used by a male, although it could be used by either sex. This part holds a disposable piece 44 shown in FIG. 12; it is made from durable plastic, and has a shape like a tubular funnel. Inside of it is an empty chamber to accept the disposable piece 44 mentioned earlier. The rim of this unit has several indentations 39 to hold the matching part 45 in order to hold the disposable piece 44 in place. The electric switch 40 is shown here with its small bulb 41 to glow at night. The wire 42 goes to the electric fan to turn it on and off. The tip 37 fits inside end 14 of the plastic tubing.

FIG. 12 shows a side view of piece 44 which is made from clear plastic as in many clear plastic cups. This piece matches and fits inside of piece 36 and is held in place when part 45 slides and goes over indentation 39 of piece 36. Tip 48 fits inside tip 37 of part 36. Inside this piece there are raised areas 47. The purpose of these elevations is to leave some room next to them so that air could go through it. This is to avoid the penis from being totally suctioned by the vacuum and air suction created by the suction fan.

FIG. 13 shows the inside of piece 44 when the observer looks into its large open end 46. Tip 48 is seen in the center. The raised areas 47 are seen extending toward tip 48 and ending before it.

FIG. 14 shows the side view of another kind of disposable plastic piece 50 which is made from clear hard plastic. This piece will match and fit inside of a durable plastic piece 55 shown in FIG. 15. This piece has a bulge 52 in its upper wall, and this is to allow this unit to be used by a male patient when he has to lie down and is not allowed to raise his head or body for urination. This is a very hard position to urinate from and this piece will be easier in that condition for collection of the urine. This can also be used by both sexes.

FIG. 15 shows the side view of another durable piece 55 to be used for holding the previously mentioned disposable piece 50 in place. The inside of this piece matches the outside shape of piece 50. The end 53 fits inside end 54. This piece is made from durable plastic, and its inside is empty, to accept the disposable piece. The rim 56 of this unit will go inside the special matching part 49 in order to hold the disposable piece 50 in place. The electric switch 58 is shown here with its small bulb 59 to glow at night. The wire 60 goes to the electric fan to turn it on and off.

FIGS. 16–19 show another collecting device to be used for collection of urine from a patient who has to lie flat on a stretcher or operating room bed, a situation such as after cardiac catheterization or coronary angioplasty. This piece is designed to stand between the thighs of the patient and in front of the penis. This piece has a flat base 72 made from plastic that stands on the bed or stretcher and extends to sides 73 and 74 to stay under the thighs of the patient. The right side 74 will sit under the lower part of right thigh, and the left side 73 will sit under the lower part of the left thigh. Then, the opening 65 can stand in front of the penis, and the plastic tube can be connected to the opening 66. The upper wall 67 of the collecting device is shown, as well as its lower wall 68. At the time of use, this unit will stand in front of the penis and the penis will be located inside the opening 65. The whole unit can be made from plastic to be a disposable piece. The stand which holds the collecting tube on the base is shown at 69, and has a front 70 and a back 69.

FIGS. 20–23 show a piece for collection of urine from female patients who have to lie flat on a stretcher or operating room bed and are not allow to raise for urination, such as after cardiac catheterization or coronary angioplasty. This piece is designed to sit between the thighs and be placed in front of the urethra of the female patient. This piece has a flat base 85 made from plastic that will stand on the bed or stretcher and will extend to sides 87 and 88 to stay under the lower surface of thighs of the patient. The right side 88 will sit under the lower part of right thigh, and the left side under the lower part of the left thigh to keep this unit in place. Then, the opening 79 will be positioned in front of the urethra of the patient, and the plastic tube will be connected to the opening 80. The upper wall of the collecting tube 77 is shown, as well as its lower wall 78. At the time of use, this unit will stand in front of the opening of the urethra of female and the opening will stand against it when a spring 84 will push it forward to stay around the opening of the urethra of the patient. The height of the collecting device can be controlled by moving it along spring 84 and tightening it in the right place with the use of a screw 83. The whole unit can be made from plastic to be a disposable piece. A piece 81 connects the back of the collecting device to a piece 76 which goes around spring 84.

FIGS. 24–27 show another version of special urinal. In this case, a small electric pump 91 is used to suction the urine instead of creation of vacuum in the container. The urinal comprises a container 90 that has two handles 97 and 98, one 97 in the top, and one 98 in the side. It also has right and left walls 99, 105. There are number markers in the side to allow measuring the amount of the urine. Pump 91 is located in the upper left corner, and it suctions the urine coming via a connection part 94 and draining into the container via a small hose 95. The electric pump is powered by electricity coming from an adaptor or a battery 93 which is located inside a space with a wall 102 having a door 100 which will allow its insertion. The urine can be drained by an opening 96 covered by a cap 101. Pump 91 comprises an electric motor 106 that rotates the blades inside a space of the pump 91. A cord 107 is connected to an electric switch 108 to turn the electric pump on and off and small glowing bulb 109 will help in locating the controller at night and is attached to the collecting device. A screw 110 holds door 100 tight in place. A piece 111 connects the cord from pump 91 to battery 93. The layers of the filters can be located inside the cover cap 101 that is designed to close the opening of the drain. When the unit is full, the urine can be drained by opening this cap and draining it to a drain.

Figure 28:
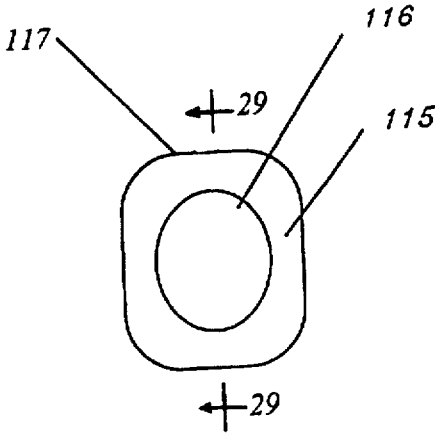
FIG. 28 is a view of a cap used with the insert of FIG. 14.
Figure 29:
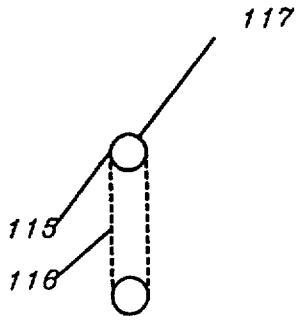
FIG. 29 is a cross-sectional view along line 29—29 in FIG. 28.

FIG. 28 shows the front view of a cap that fits and covers the opening of a collecting device such as the one shown in FIG. 14. An edge 117 goes over edge 49 to hold this part in place. An opening 116 stands in front of the tip of the penis. The outside part 115 prevents droplets of urine from leaving the inside of the collecting device, and this will prevent contamination of the outside area if such were to occur. The cap can be easily attached and removed. The collecting device may also have a cover to close its opening after use.

Figure 30:
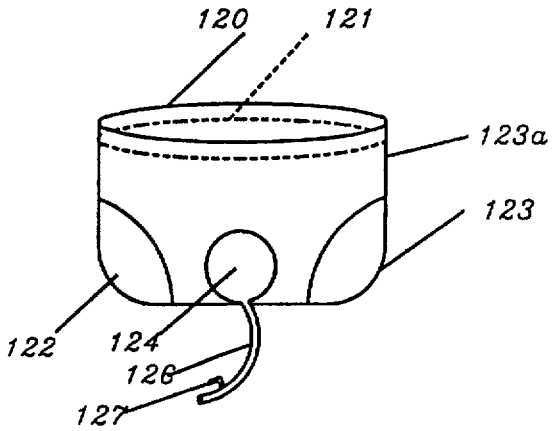
FIG. 30 is a front view of a special lady's pants containing a collection device.
Figure 31:
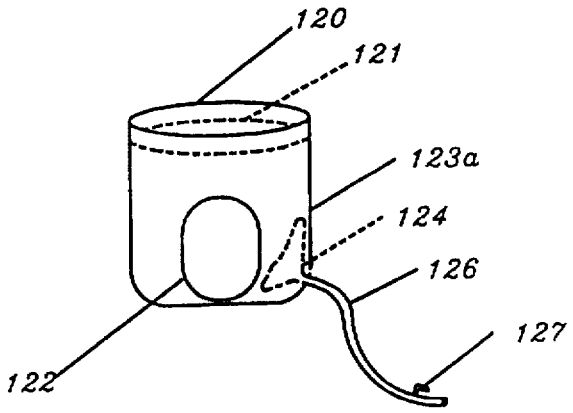
FIG. 31 is a left side view of FIG. 30.

FIGS. 30 and 31 show a special pants designed for ladies to wear. The pants will have piece 124 in the front middle that is held in place on the pants' body 123A to collect urine from a female and to carry the urine to a plastic tube 126 that can be closed by a three-way stopcock 127. An elastic band 121 at the upper edge 120 holds the pants on the person's body. The right foot and thigh go through an opening 122 and the left foot and thigh go through an opening 123.

The piece 124 is the collecting device that is held in place to collect the urine from the female wearing the pants, and it will carry the urine to plastic tube 126. The three-way stopcock allows the current of the urine to be stopped, and it may also have a connection part to allow disconnection of the tube in its length and reconnection again. This is used in certain cases, for example in certain circumstances where the collecting device is to be worn by a person who is going to sit in a car for a long drive. The tube can be held under pants and dress. The three-way stopcock closes the opening of the tube, and then when needed, the person connects the tube to the container to allow urine flow to be drained. The container is disconnected after use.

Figure 32:
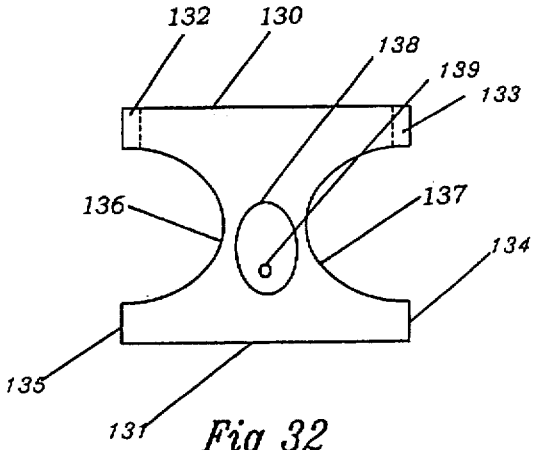
FIG. 32 is an inside view of a special diaper containing a collection device, the special diaper being spread flat.
Figure 33:
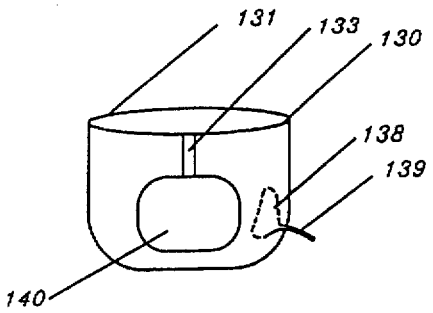
FIG. 33 is a right side view of FIG. 32 with the side flaps of the special diaper attached to each other.

FIGS. 32 and 33 show a collecting unit made from a diaper and a collecting device. This will give the advantage of using a diaper to absorb small amounts of urine in a patient which is using the special urinal. A patient that can turn the urinal switch on and off may use this unit to eliminate the use of a Foley catheter which has its own complications, such as infection. Here the front upper rim 130 of the diaper is shown with its left front corner 132 and right front corner 133, both having adhesive surfaces covered by a plastic cover. The collecting device 138 is in the upper middle and the inside opening of the tube which takes the urine is 139. The left side rim which has an elastic band is 136 and the similar right side rim is 137. The back rim is 131, and its left corner part is 135 and right corner part is 134.

FIG. 33 shows the front and back parts joined together with adhesive corners 132 and 133 of the front piece 130 adhered to corners 134 and 135 of the back piece. This will hold the collecting piece 138 in place in front of the urethra of the female person allowing the urine to be collected by tube 139. The space 140 shows the opening where the right thigh will be positioned.

Figure 34:
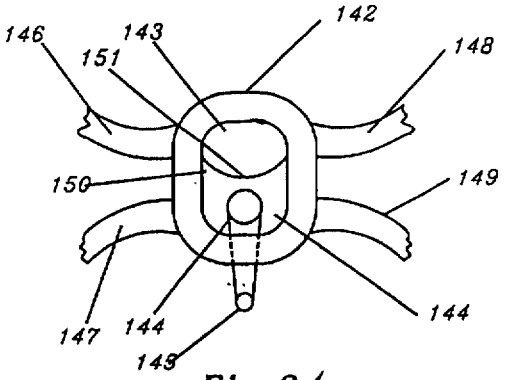
FIG. 34 is a view of another woman's collection device.
Figure 35:
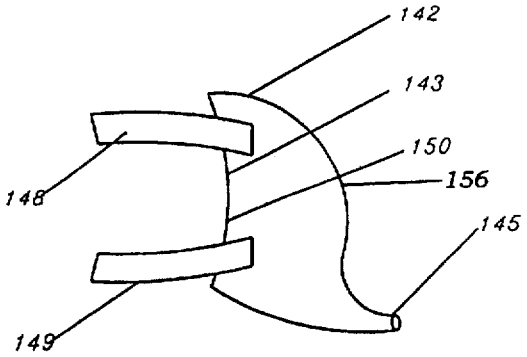
FIG. 35 is a right side view of FIG. 34.

FIGS. 34 and 35 show the front view of a collecting part designed to be used by women. This part has four straps that will allow it to be held in place with the upper ones going around the belt area and the lower ones to go from the buttock area to join the upper straps and hold the unit in place. The part has an edge 142 with a chamber 143 and inside opening 144 to a tube for conveying urine to an outside part 145. A thin plastic wall 150 is to prevent urine spillage and its upper border 151 is shown here. The left upper strap is 146, upper right strap is 148, the lower left strap is 147, and the lower right strap is 149. The outer wall of this unit is shown at 156.

Smaller units can be made using the same basic ideas, in order to be used in stretchers or similar places. In such a case, the container will be small enough to be hung on the side of stretchers or the operating room bed, etc . . . with use of snaps.

What is claimed is:

1. A urinal comprising a collection device for placement proximate genitalia to receive urine from a person, a container for collection of urine, tubing from the collection device to the container for conveying urine from the collection device to the container, means for sucking urine from the collection device so as to cause the urine to pass through the tubing and into the container, characterized in that said container comprises a bottom wall and an internal partition spaced above said bottom wall so that both the bottom wall and the partition define a bottom zone of the container that is in communication with an overlying zone by virtue of said partition not completely enclosing the bottom zone, and in that said tubing discharges urine into the container at a location in said bottom zone that is below an imperforate portion of said partition, and in which said container has an opening which is above said partition proximate a sidewall portion of the container and communicates with said overlying zone and via which urine may be poured out of the container when the container is tipped, and said partition comprises a perforate zone proximate said sidewall portion for allowing urine in the bottom zone to pass through said partition and along said sidewall portion toward said opening as the container is being tipped to empty urine from it.

2. A urinal as set forth in claim 1 including a further internal partition overlying the first-mentioned partition which, with the bottom wall, define the bottom zone.

3. A urinal as set forth in claim 2 in which said further internal partition does not obstruct urine that passes from the bottom zone through the perforate zone of the first-mentioned internal partition along said sidewall portion as the container is being tipped to empty urine from it.

4. A urinal as set forth in claim 3 in which said further internal partition and the first-mentioned internal partition are each substantially parallel with said bottom wall of the container, said further internal partition is imperforate except for being open where it overlies the perforate zone of the first-mentioned internal partition, and said first-mentioned internal partition is open at a location that is below said further internal partition where said further internal partition is imperforate and that is proximate said sidewall portion of the container opposite the location of said perforate zone of said first-mentioned internal partition.

5. A urinal as set forth in claim 1 in which said internal partition comprises a wall that is generally parallel with the bottom wall of the container.

6. A urinal comprising a collection device for placement proximate genitalia to receive urine from a person, a container for collection of urine, tubing from the collection device to the container for conveying urine from the collection device to the container, means for sucking urine from the collection device so as to cause the urine to pass through the tubing and into the container, characterized in that said container comprises a bottom wall and an internal partition spaced above said bottom wall so that both the bottom wall and the partition define a bottom zone of the container that is in communication with an overlying zone by virtue of said partition not completely enclosing the bottom zone, and in that said tubing discharges urine into the container at a location in said bottom zone that is below an imperforate portion of said partition, and in which said container comprises a sidewall extending upwardly from said bottom wall and a top wall that closes the top of said sidewall, an opening that is proximate the junction of said top wall and said sidewall through which urine may be poured out of the container when the container is tipped to empty urine from it, and in which said tubing enters said container at a level that is above said opening relative to the bottom wall and passes downwardly to open at said bottom zone.

7. A urinal as set forth in claim 6 in which said tubing enters the container proximate said opening and comprises a separable connection just exterior of the container.

8. A urinal as set forth in claim 7 in which said means for sucking urine from the collection device comprises a fan mounted in a mounting on said container to create a vacuum in the container.

9. A urinal as set forth in claim 8 in which said mounting comprises a receptacle on said container, and the container including a space for a filter means that is disposed between the fan and the interior of the container to filter urine odor from gas drawn out of the container by the fan, in which said space is bounded by said receptacle, and in which said filter means and said fan mount on the exterior of the container by sliding into such receptacle.

10. A urinal comprising a collection device for placement proximate genitalia to receive urine from a person, a container for collection of urine, tubing from the collection device to the container for conveying urine from the collection device to the container, means for sucking urine from the collection device so as to cause the urine to pass through the tubing and into the container, characterized in that said container comprises a bottom wall and an internal partition spaced above said bottom wall so that both the bottom wall and the partition define a bottom zone of the container that is in communication with an overlying zone by virtue of said partition not completely enclosing the bottom zone, and in that said tubing discharges urine into the container at a location in said bottom zone that is below an imperforate portion of said partition, and in which said means for sucking urine from the collection device comprises a fan mounted in a mounting on said container to create a vacuum in the container that causes urine to be sucked from the collection device through the tubing and into the container, characterized further in that the fan mounting on the container includes a space for a filter means that is disposed between the fan and the interior of the container to filter urine odor from gas drawn out of the container by the fan.

11. A urinal as set forth in claim 10 in which said space is bounded by a receptacle on said container, and in which said filter means and said fan mount on the container by sliding into such receptacle.

* * * * *